US012054947B1

(12) United States Patent
Essa Alhusain

(10) Patent No.: US 12,054,947 B1
(45) Date of Patent: Aug. 6, 2024

(54) MULTI-LAYER WEDGE ANCHORAGE FOR FRP PLATES AND FRP TENDONS

(71) Applicant: KING FAISAL UNIVERSITY, Al-Ahsa (SA)

(72) Inventor: Mustafa Abdullah Essa Alhusain, Al-Ahsa (SA)

(73) Assignee: KING FAISAL UNIVERSITY, Al-Ahsa (SA)

( * ) Notice: Subject to any disclaimer, the term of this patent is extended or adjusted under 35 U.S.C. 154(b) by 0 days.

(21) Appl. No.: 18/406,769

(22) Filed: Jan. 8, 2024

(51) Int. Cl.
*E04C 5/12* (2006.01)
*E04C 5/00* (2006.01)

(52) U.S. Cl.
CPC ..... *E04C 5/122* (2013.01)

(58) Field of Classification Search
CPC ..... E04C 5/122; E04C 5/127
USPC ..... 52/223.13
See application file for complete search history.

(56) References Cited

U.S. PATENT DOCUMENTS 2,609,586 A * 9/1952 Parry ..... E04C 5/12 52/223.13
2,751,660 A 6/1956 Walter
2,950,576 A * 8/1960 Rubenstein ..... E04H 9/00 52/309.3
3,060,639 A * 10/1962 Fields ..... E04G 21/121 52/223.13
3,099,109 A 7/1963 Volker
3,263,384 A 8/1966 Middendorf
3,267,539 A * 8/1966 Mark ..... F16G 11/05 403/275
3,399,865 A * 9/1968 Kelly ..... E04G 21/121 254/29 A
3,554,492 A * 1/1971 Beghi ..... E04G 21/121 52/223.13

(Continued)

FOREIGN PATENT DOCUMENTS

CN 203097117 U * 7/2013 ..... E04C 5/12
CN 210529517 U 5/2020

(Continued)

OTHER PUBLICATIONS

Mohee, Faizul M., and Adil Al-Mayah. "Effect of barrel, wedge material and thickness on composite plate anchor performance through analytical, finite element, experimental and 3D prototype investigations." Engineering Structures 175 (2018): 138-154.

(Continued)

*Primary Examiner* — Brian D Mattei
*Assistant Examiner* — Joseph J. Sadlon
(74) *Attorney, Agent, or Firm* — Nath, Goldberg & Meyer; Joshua B. Goldberg

(57) ABSTRACT

A wedge anchorage includes the components needed to secure two fiber-reinforced polymer (FRP) plates and two FRP tendons. The components include an outer barrel, two inner barrels, two outer wedges, two inner wedges, and a middle wedge. FRP tendons are secured in through holes formed between the respective upper and lower outer wedges and upper and lower inner wedges. A first FRP plate is secured between the upper inner wedge and a middle wedge, while a second FRP plate is secured between the lower inner wedge and the middle wedge.

6 Claims, 5 Drawing Sheets

(56) References Cited

U.S. PATENT DOCUMENTS 3,646,748 A * 3/1972 Lang ..... E04C 5/08 57/7
3,659,321 A 5/1972 Laurent
3,795,949 A * 3/1974 Shorter ..... E04C 5/122 52/223.13
3,956,797 A * 5/1976 Brandestini ..... E04C 5/122 52/223.13
3,965,541 A * 6/1976 Davison ..... E04C 5/125 52/223.13
4,000,623 A * 1/1977 Meardi ..... E02D 5/76 52/223.13
4,124,321 A * 11/1978 Hutchins ..... E04B 7/04 52/223.13
4,223,497 A * 9/1980 Edwards ..... E04C 5/12 52/223.13
4,309,033 A * 1/1982 Parker, Jr. ..... A63B 49/025 473/540
4,367,568 A 1/1983 Weiser
4,448,002 A * 5/1984 Rehm ..... E04C 5/12 52/223.13
4,454,633 A * 6/1984 de la Fuente ..... E04G 21/121 52/223.13
4,640,068 A * 2/1987 Jungwirth ..... E04C 5/122 52/223.13
4,671,034 A 6/1987 Rehm et al.
4,744,691 A * 5/1988 Thal ..... E04C 5/122 52/223.13
5,374,135 A * 12/1994 Folsom ..... F16D 1/094 403/362
5,493,828 A * 2/1996 Rogowsky ..... E04C 5/122 52/223.13
5,713,169 A * 2/1998 Meier ..... E04C 5/122 403/374.1
5,775,849 A * 7/1998 Sorkin ..... E04C 5/10 405/259.1
5,839,235 A * 11/1998 Sorkin ..... E04C 5/10 52/223.13
6,195,949 B1 * 3/2001 Schuyler ..... E04C 5/12 52/223.13
6,487,757 B1 * 12/2002 Stubler ..... E01D 19/14 24/115 M
6,560,939 B2 * 5/2003 Sorkin ..... E04C 5/12 52/223.13
6,655,104 B2 * 12/2003 Kadotani ..... E04C 5/165 52/223.13
6,718,707 B2 * 4/2004 Marshall ..... F16G 11/048 403/368
7,765,752 B2 * 8/2010 Hayes ..... E04C 5/122 403/374.1
7,963,078 B1 * 6/2011 Sorkin ..... E04C 5/122 403/374.1
8,650,820 B2 * 2/2014 Bocquet ..... E04C 5/127 52/745.19
8,794,596 B2 * 8/2014 Kim ..... E04G 21/12 52/223.13
8,869,476 B2 * 10/2014 Delavaud ..... E04C 5/12 14/18
9,315,998 B1 * 4/2016 Aral ..... E04C 5/122
9,506,250 B2 * 11/2016 Gilling ..... F16B 9/056
9,657,453 B1 * 5/2017 Shin ..... E02D 5/80
10,221,570 B2 * 3/2019 Schmidt ..... E04C 5/122
10,745,916 B2 * 8/2020 Hayes ..... E04C 5/161
10,947,754 B2 * 3/2021 Sorkin ..... F16G 11/048
11,028,587 B2 * 6/2021 Nishino ..... E04C 5/12
11,326,347 B2 * 5/2022 Al-Mayah ..... E04C 5/122
2002/0157333 A1 * 10/2002 Kadotani ..... E04C 5/165 52/223.13
2005/0050817 A1 * 3/2005 Shin ..... E04C 5/122 52/223.1
2006/0196146 A1 * 9/2006 Schwegler ..... E04G 23/0218 52/741.15
2007/0007405 A1 * 1/2007 Al-Mayah ..... E04C 5/122 248/200
2008/0302035 A1 * 12/2008 Shin ..... E02D 5/80 52/223.13
2009/0288355 A1 * 11/2009 Platt ..... E04C 3/294 52/223.13
2009/0308017 A1 * 12/2009 Kadoya ..... E04C 5/16 52/708
2010/0303540 A1 * 12/2010 Kim ..... E04C 5/165 403/305
2012/0201996 A1 * 8/2012 Meyer ..... E04C 5/015 428/69
2014/0138596 A1 * 5/2014 Ross ..... F16G 11/04 256/47
2017/0218628 A1 * 8/2017 Sabbah ..... E04C 5/12
2018/0094436 A1 * 4/2018 Sorkin ..... E04B 1/4114
2018/0335061 A1 * 11/2018 Song ..... E04C 5/165
2024/0093494 A1 * 3/2024 Kasuga ..... E04C 5/122

FOREIGN PATENT DOCUMENTS

DE 846346 8/1952
DE 955818 C 1/1957
DE 969806 C * 7/1958 ..... E04C 5/122
DE 1080284 B * 7/1958 ..... E04C 5/122
DE 1091309 B 10/1960
DE 1278718 B * 9/1968 ..... E04C 5/122
DE 1906571 A1 * 1/1971 ..... E04C 5/122
DE 2322991 A1 * 11/1973 ..... E04C 5/122
DE 2950303 A1 7/1981
DE 3118220 A1 11/1982
DE 3925368 A1 * 2/1991 ..... E04G 21/12
EP 949389 A1 * 10/1999 ..... E04C 5/122
EP 1215347 A2 * 6/2002 ..... E04C 5/122
EP 3128093 A1 * 2/2017 ..... E04C 5/122
FR 1301226 A * 8/1962 ..... E04C 5/122
FR 1452219 A * 2/1966 ..... E04C 5/122
FR 1588286 A * 4/1970 ..... E04C 5/122
FR 2077447 A1 * 10/1971 ..... E04C 5/122
GB 679629 A * 9/1952 ..... E04C 5/122
GB 1307513 A * 2/1973 ..... E04C 5/122
KR 20040079129 A * 9/2004 ..... C08L 63/00
WO WO-9731167 A1 * 8/1997 ..... E04C 5/122
WO WO-0120081 A1 * 3/2001 ..... E01D 19/14
WO WO-2005033433 A1 * 4/2005 ..... E04C 5/085
WO WO-2011126170 A1 * 10/2011 ..... E02D 5/34
WO WO-2012140462 A1 * 10/2012 ..... B29C 45/14426

OTHER PUBLICATIONS

Mohee, Faizul M., Adil Al-Mayah, and Alan Plumtree. "Development of a novel prestressing anchor for CFRP plates: Experimental investigations." Composite Structures 176 (2017): 20-32.

* cited by examiner

MULTI-LAYER WEDGE ANCHORAGE FOR FRP PLATES AND FRP TENDONS

BACKGROUND

1. Field

The present disclosure relates to a multi-layer wedge anchorage for fiber-reinforced polymer (FRP) plates and FRP tendons, in particular a wedge anchorage for two FRP plates and two FRP tendons.

2. Description of the Related Art

Concrete and other masonry or cementitious materials typically have high compressive strength but lower tensile strength. Thus, when using concrete as a structural member, for example, in a building, bridge, pipe, pier, culvert, tunnel, or the like, it is conventional to incorporate reinforcing members to impart the necessary tensile strength. Historically, the reinforcing members are steel or other metal reinforcing rods or bars, i.e., "rebar". Such reinforcing members may be placed under tension to form pre-stressed or post-tensioned concrete structures.

Composite reinforcement materials, specifically fiber reinforced polymers (FRP), have been used to strengthen existing concrete and masonry structures. FRP are strong, lightweight, highly durable, and can be easily installed in areas of limited access. These fiber reinforced polymers typically contain a glass or carbon fiber textile that is embedded in a matrix.

SUMMARY

There is a need for an anchorage mechanism to secure fiber-reinforced polymer (FRP) plates and tendons when used to reinforce concrete. The present disclosure is directed to a wedge anchorage that addresses problems encountered in the past when using FRP elements to reinforce concrete.

The present disclosure is directed to a wedge anchorage that includes the components needed to secure two FRP plates and two FRP tendons. The components include an outer barrel, two inner barrels, two outer wedges, two inner wedges, and a middle wedge. FRP tendons are secured in through holes formed between the respective upper and lower outer wedges and upper and lower inner wedges. A FRP plate is secured between the upper inner wedge and the lower inner wedge.

In an embodiment, the present disclosure is directed to a wedge anchorage. The wedge anchorage includes a cylindrical outer barrel and an upper inner barrel having an outer surface conforming to and contacting an inner surface of the outer barrel. The wedge anchorage also includes an upper outer wedge having a top surface and a bottom surface, wherein the top surface of the upper outer wedge mates with a bottom surface of the upper inner barrel, and the bottom surface of the upper outer wedge includes a groove. An upper inner wedge has a top surface and a bottom surface, the top surface includes three grooves whereby, when the top surface of the upper inner wedge is mated with the bottom surface of the upper outer wedge, the three grooves in the bottom surface of the upper outer wedge align with the three grooves in the top surface of the upper inner wedge to form three upper through holes. Three upper fiber-reinforced polymer (FRP) tendons are included, with each of the three upper FRP tendons being located in a respective one of the three upper through holes.

The wedge anchorage includes a middle wedge and a first FRP plate located between a bottom surface of the upper inner wedge and a top surface of the middle wedge. A lower inner wedge has a top surface and a bottom surface, wherein the bottom surface comprises three grooves. A second FRP plate is located between a bottom surface of the middle wedge and a top surface of the lower inner wedge. A lower outer wedge has a top surface and a bottom surface, wherein the top surface comprises a groove whereby, when the top surface of the lower outer wedge mates with the bottom surface of the lower inner wedge, the groove in the top surface of the lower outer wedge aligns with the groove in the bottom surface of the lower inner wedge to form a lower through hole. A lower FRP tendon is included, the lower FRP tendon being located in the lower through hole. A lower inner barrel has an outer surface conforming to and contacting an inner surface of the outer barrel, the lower inner barrel includes a top surface, wherein the top surface of the lower inner barrel mates with the bottom surface of the lower outer wedge.

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
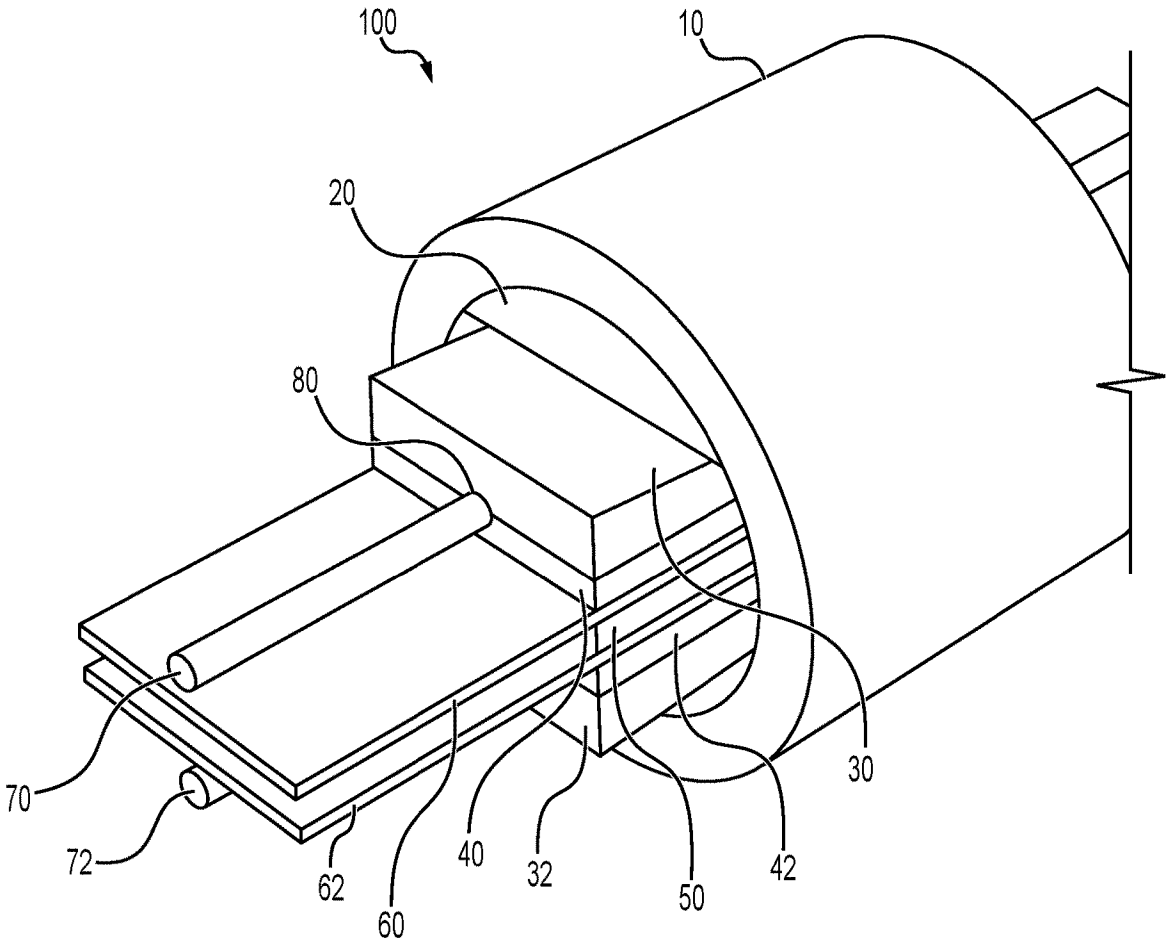
FIG. 1 is a perspective view of a wedge anchorage before presetting the wedges.
Figure 2:
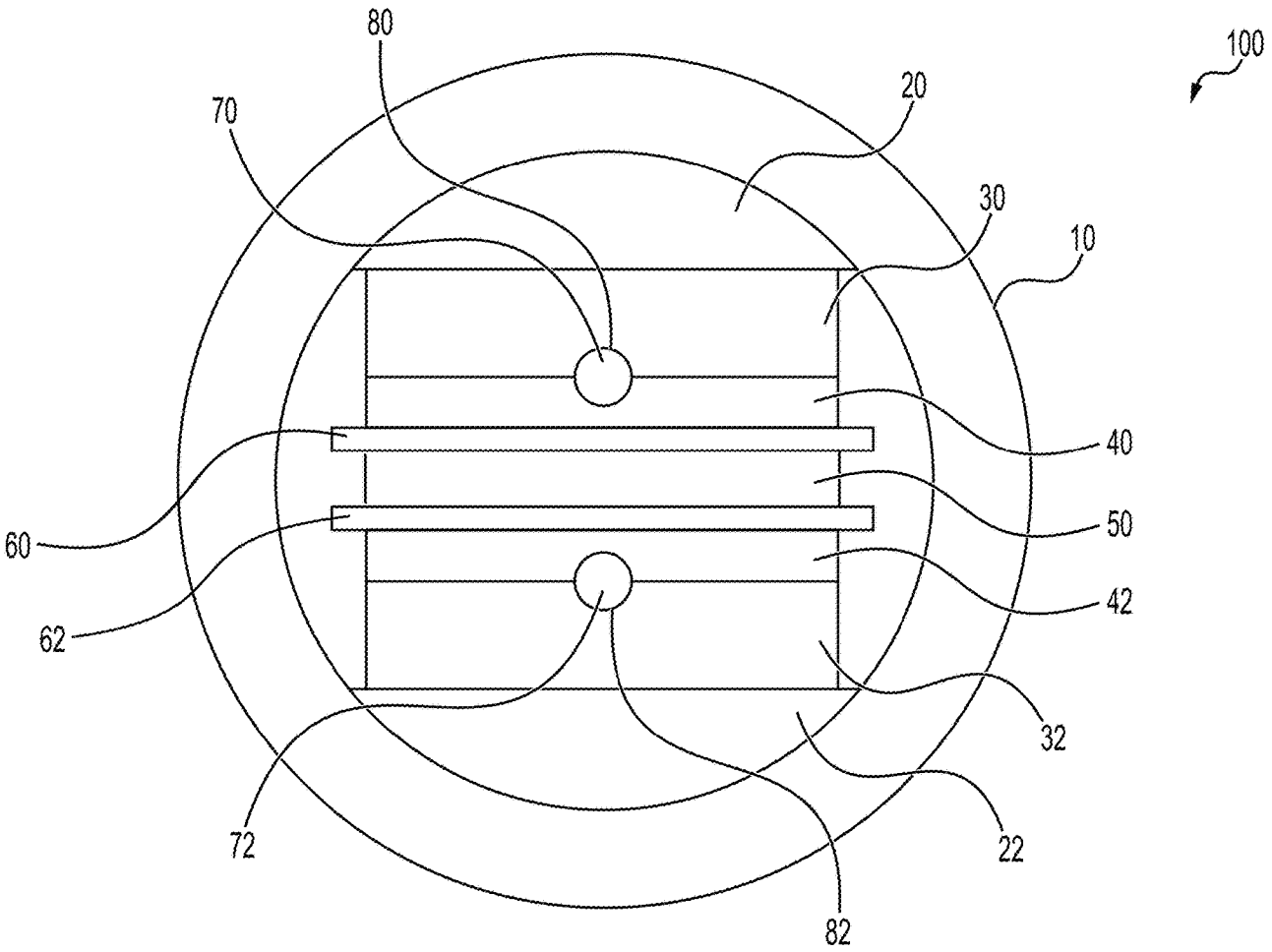
FIG. 2 is a front view of the wedge anchorage of FIG. 1 before presetting the wedges.
Figure 3:
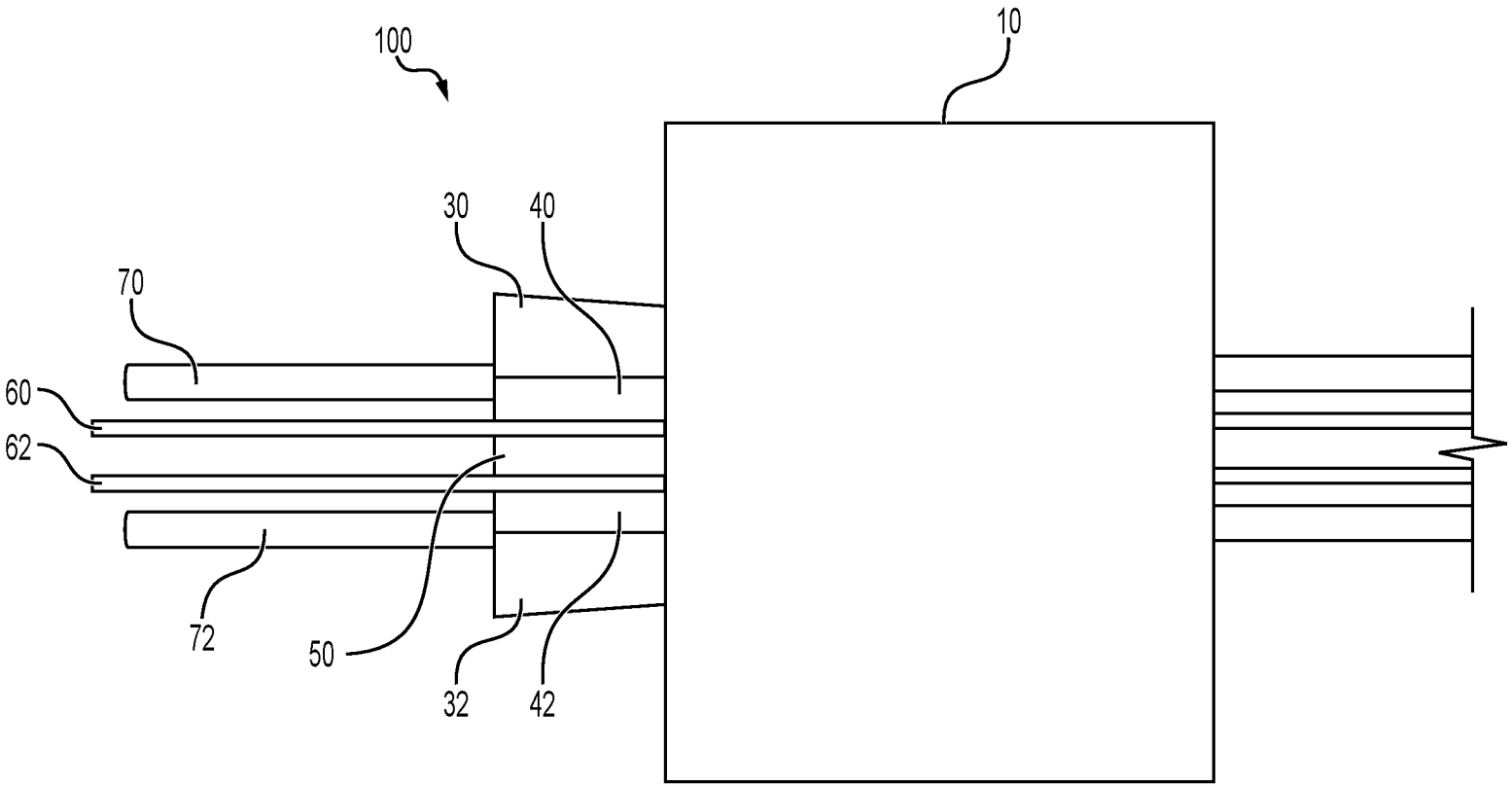
FIG. 3 is a side view of the wedge anchorage of FIG. 1 before presetting the wedges.

It should be understood that the drawings described above or below are for illustration purposes only with emphasis generally being placed upon illustrating the principles of the present teachings. The drawings are not intended to limit the scope of the present teachings in any way.

Throughout the application, where compositions are described as having, including, or comprising specific components, or where processes are described as having, including, or comprising specific process steps, it is contemplated that compositions of the present teachings can also consist essentially of, or consist of, the recited components, and that the processes of the present teachings can also consist essentially of, or consist of, the recited process steps.

It is noted that, as used in this specification and the appended claims, the singular forms "a", "an", and "the" include plural references unless the context clearly dictates otherwise. The use of the terms "include," "includes", "including," "have," "has," or "having" should be generally understood as open-ended and non-limiting unless specifically stated otherwise.

The present disclosure is directed to a wedge anchorage for use with fiber-reinforced polymer (FRP) plates and tendons in reinforced concrete. FRP materials are composite materials that are typically comprised of strong fibers embedded in a resin matrix. The fibers provide strength and stiffness to the composite and generally carry most of the applied loads. The matrix acts to bond and protect the fibers and to provide for transfer of stress from fiber to fiber through shear stresses. The most common fibers are glass, carbon, and synthetic fibers. FRP composites have very high strength characteristics and are nonconductive, noncorrosive, and lightweight.

The subject matter of this disclosure is particularly drawn to a wedge anchorage that secures two FRP plates and two FRP tendons. FIGS. 1-5 depict a particular embodiment of the present disclosure and the following description references the various elements and components as shown in the respective figures.

Turning now to FIGS. 1-5, a wedge anchorage 100 includes a cylindrical outer barrel 10. An upper inner barrel 20 has an outer surface conforming to and contacting an inner surface of the outer barrel 10. An upper outer wedge 30 has a top surface and a bottom surface. The top surface of the upper outer wedge 30 mates with a bottom surface of the upper inner barrel 20. The bottom surface of the upper outer wedge 30 includes a groove.

An upper inner wedge 40 has a top surface and a bottom surface. The top surface of the upper inner wedge 40 includes groove. When the top surface of the upper inner wedge 40 is mated with the bottom surface of the upper outer wedge 30, the groove in the bottom surface of the upper outer wedge 30 aligns with the groove in the top surface of the upper inner wedge 40 to form an upper through hole 80. The upper through hole 80 is formed to receive an FRP tendon. In a particular embodiment, the upper through hole 80 receives an upper FRP tendon 70.

The wedge anchorage 100 also includes a middle wedge 50. A first FRP plate 60 is positioned between a bottom surface of the upper inner wedge 40 and a top surface of the middle wedge 50.

A lower inner wedge 42 has a top surface and a bottom surface, with the bottom surface having three grooves. A second FRP plate 62 is located between a bottom surface of the middle wedge 50 and the top surface of the lower inner wedge 42.

A lower outer wedge 32 has a top surface and a bottom surface. The top surface of the lower outer wedge 32 includes a groove. When the top surface of the lower outer wedge 32 mates with the bottom surface of the lower inner wedge 42, the groove in the top surface of the lower outer wedge 32 aligns with the groove in the bottom surface of the lower inner wedge 42 to form a lower through hole 82. The lower through hole 82 is formed to receive an FRP tendon. In a particular embodiment, the lower through hole 82 receives a lower FRP tendon 72.

A lower inner barrel 22 has an outer surface conforming to and contacting an inner surface of the outer barrel 10. The lower inner barrel 22 has a top surface. The top surface of the lower inner barrel 22 mates with the bottom surface of the lower outer wedge 32.

In this particular embodiment of the wedge anchorage, FIGS. 1-4 show the wedge anchorage with the two FRP plates and two FRP tendons before a presetting stage (after being assembled together but before being in the final position/configuration). FIG. 5 shows the wedge anchorage with the plates and tendons after the presetting stage, when all of the wedges, plates and tendons are in a final position.

Figure 4:
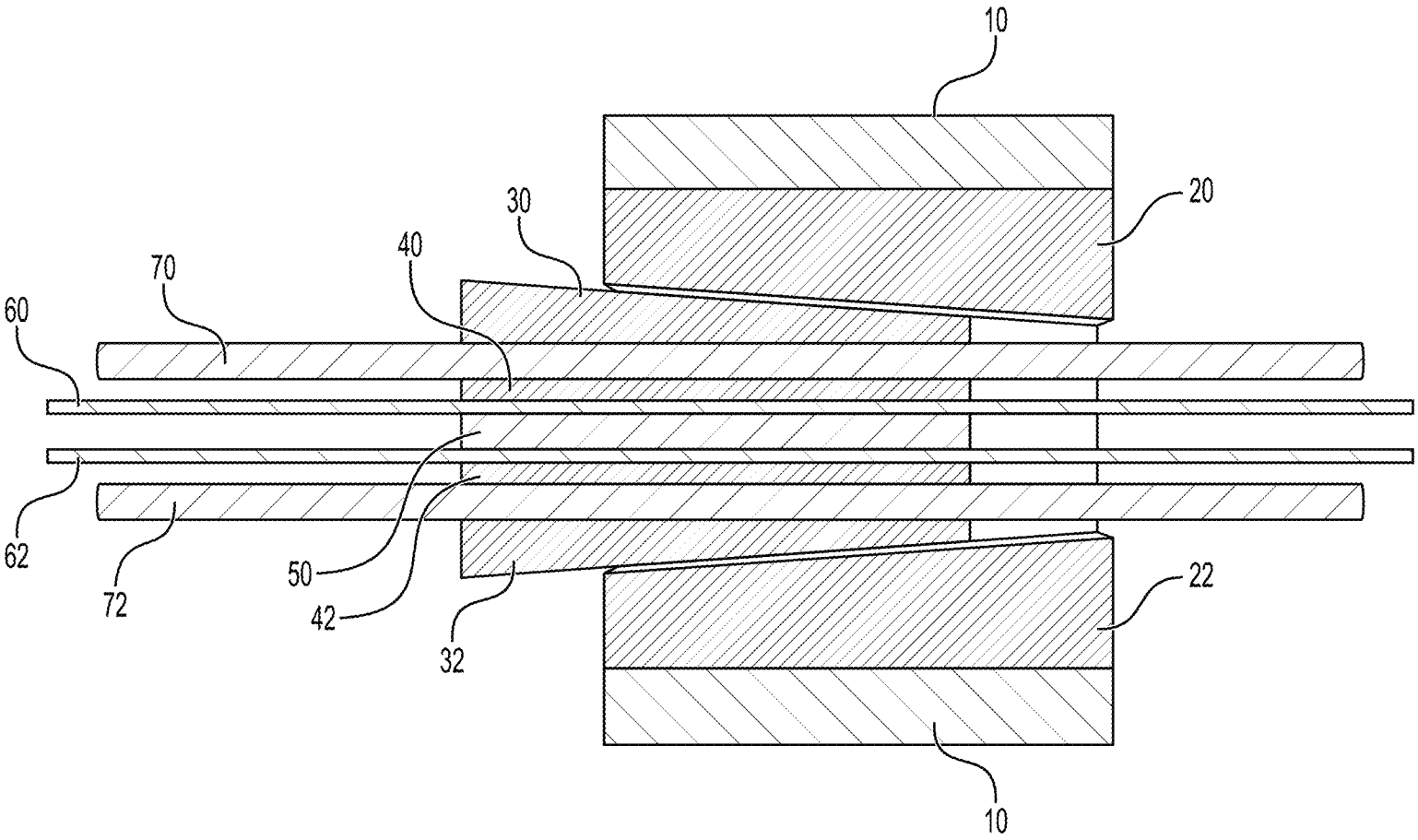
FIG. 4 is a side cross-section view of the wedge anchorage of FIG. 1 before presetting the wedges.
Figure 5:
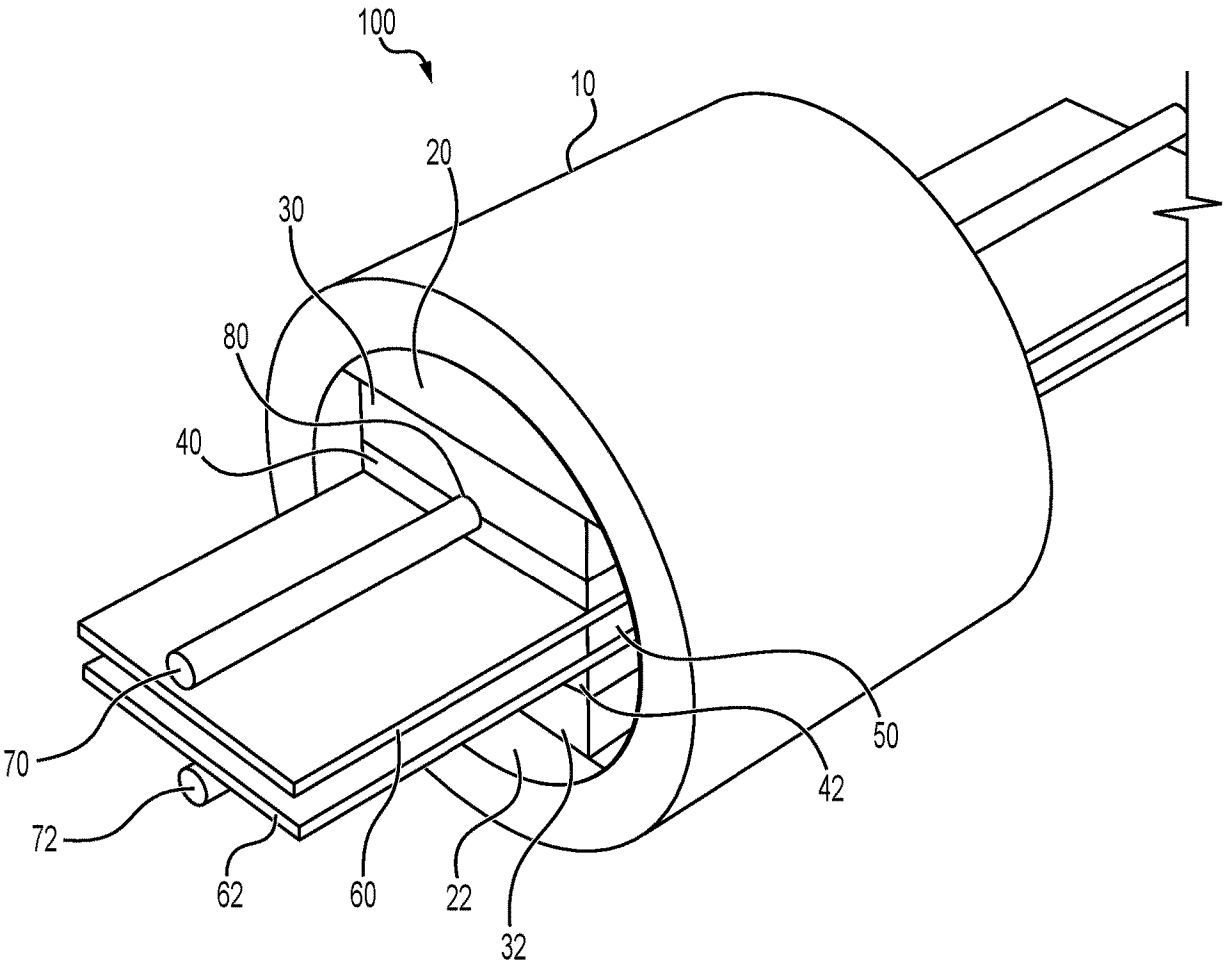
FIG. 5 is a perspective view of the wedge anchorage of FIG. 1 after presetting the wedges.

Turning now specifically to FIG. 4, it is contemplated that each of upper inner barrel 20, upper outer wedge 30, lower outer wedge 32, and lower inner barrel 22 has a thickness that varies in a longitudinal (length-wise) direction. In particular, it can be seen in FIG. 4 that upper outer barrel 20 and inner outer barrel 22 have respective thicknesses that increase along the length of the barrel (as indicated from left to right in the figure). Also, upper outer wedge 30 and lower outer wedge 32 have respective thicknesses that decrease along the length of the wedge (as indicated from left to right in the figure).

Furthermore, as can be seen in FIG. 4, upper outer wedge 30 can have a flat bottom surface and lower outer wedge 32 can have a flat top surface. In addition, each of first middle wedge 50 and second middle wedge 52 can have flat top and flat bottom surfaces. Also, the top surfaces of upper inner wedge 40 and lower inner wedge 42 can be flat, as can be the respective bottom surfaces thereof. It is also shown in FIG. 4 that the upper and lower tendons are located in the respective upper and lower through holes formed by the grooves present in the respective upper and lower outer wedges, as well as the upper and lower inner wedges.

It is further contemplated that upper inner barrel 20 is affixed to an inner surface of outer barrel 10 by any one or more of multiple different methods. In a particular embodiment, upper inner barrel 20 is affixed to the inner surface of outer barrel 10 by welding. Likewise, lower inner barrel 22 is affixed to the inner surface of outer barrel 10 by any suitable method. In a particular embodiment, lower inner barrel 22 is affixed to the inner surface of outer barrel 10 by welding.

It is also contemplated that the components of the wedge anchorage are made of a suitably strong material to secure the FRP plates and tendons. In a particular embodiment, the outer barrel, each inner barrel, and each wedge are made of metal. A non-limiting example of a metal to be used for each component is steel, however any suitable metal material can be used.

In an embodiment, the FRP plates and tendons can be positioned directly between the wedges. In an alternative embodiment, a soft material can be positioned between the plates and the wedges. A non-limiting example of a soft material that can be placed between the plates and wedges is a copper sheath. Furthermore, when assembling the wedge anchorage, a high-pressure lubricant can be applied between the respective mating surfaces of the inner barrels and outer wedges to allow a smooth insertion of the wedges into the anchorage.

It is to be understood that the present subject matter is not limited to the specific embodiments described above but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A wedge anchorage comprising:

a cylindrical outer barrel;

an upper inner barrel having an outer surface conforming to and contacting an inner surface of the cylindrical outer barrel;

an upper outer wedge having a top surface and a bottom surface, wherein the top surface of the upper outer wedge mates with a bottom surface of the upper inner barrel, and the bottom surface of the upper outer wedge includes a groove;

an upper inner wedge having a top surface and a bottom surface, wherein the top surface comprises a groove whereby, when the top surface of the upper inner wedge is mated with the bottom surface of the upper outer wedge, the groove in the bottom surface of the upper outer wedge aligns with the groove in the top surface of the upper inner wedge to form an upper through hole;

an upper fiber-reinforced polymer (FRP) tendon, the upper FRP tendon located in the upper through hole;

a middle wedge;

a first FRP plate located between a bottom surface of the upper inner wedge and a top surface of the middle wedge;

a lower inner wedge having a top surface and a bottom surface, wherein the bottom surface comprises a groove;

a second FRP plate located between a bottom surface of the middle wedge and a top surface of the lower inner wedge;

a lower outer wedge having a top surface and a bottom surface, wherein the top surface comprises a groove whereby, when the top surface of the lower outer wedge mates with the bottom surface of the lower inner wedge, the groove in the top surface of the lower outer wedge aligns with the groove in the bottom surface of the lower inner wedge to form a lower through hole;

a lower FRP tendon, the lower FRP tendon located in the lower through hole; and a lower inner barrel having an outer surface conforming to and contacting an inner surface of the cylindrical outer barrel, the lower inner barrel comprising a top surface, wherein the top surface of the lower inner barrel mates with the bottom surface of the lower outer wedge.

2. The wedge anchorage according to claim 1, wherein the upper inner barrel has a thickness that varies in a longitudinal direction.

3. The wedge anchorage according to claim 1, wherein the upper outer wedge has a thickness that varies in a longitudinal direction.

4. The wedge anchorage according to claim 1, wherein the lower outer wedge has a thickness that varies in a longitudinal direction.

5. The wedge anchorage according to claim 1, where in the lower inner barrel has a thickness that varies in a longitudinal direction.

6. The wedge anchorage according to claim 1, wherein each of the upper inner barrel, the upper outer wedge, the lower outer wedge, and the lower inner barrel have a thickness that varies in a longitudinal direction.

* * * * *